US006135547A

United States Patent [19]

Katz

[11] Patent Number: 6,135,547

[45] Date of Patent: Oct. 24, 2000

[54] UNITARY TABLE AND SURROUNDIVE SEATING

[76] Inventor: Pinckas Katz, 2281 National Dr., Brooklyn, N.Y. 11234

[21] Appl. No.: 08/824,712

[22] Filed: Apr. 14, 1997

[51] Int. Cl.[7] ..... A47B 83/02

[52] U.S. Cl. ..... 297/158.3; 297/170

[58] Field of Search ..... 297/158.5, 170, 297/172, 157.1, 158.1, 158.3, 440.1, 440.14, 440.2, 440.22, 171, 135, 159.1, 158.2, 147; 108/50.11

[56] References Cited

U.S. PATENT DOCUMENTS

| | | |
|---|---|---|
| D. 158,160 | 4/1950 | Viola . |
| D. 158,522 | 5/1950 | Smith et al. . |
| D. 172,195 | 5/1954 | Richardson . |
| D. 183,814 | 10/1958 | Scott . |
| D. 199,976 | 1/1965 | Levoy . |
| D. 282,608 | 2/1986 | Crowe . |
| 1,073,762 | 9/1913 | Kade . |
| 1,429,939 | 9/1922 | Eichman . |
| 1,903,954 | 4/1933 | Blumenthal . |
| 2,077,855 | 4/1937 | Riess . |
| 2,382,183 | 8/1945 | Thaxton . |
| 2,509,332 | 5/1950 | Budd . |
| 2,570,301 | 10/1951 | Adsit . |
| 3,100,127 | 8/1963 | Barto . |
| 3,261,640 | 7/1966 | Straits . |
| 3,574,394 | 4/1971 | VonPongracz . |
| 5,452,936 | 9/1995 | Koehring ..... 297/158.1 X |
| 5,782,526 | 7/1998 | Ott . |
| 5,785,379 | 7/1998 | Pelletier . |

OTHER PUBLICATIONS

Jay Buchbinder Industries Product Catalog 11, Rev. Nov. 1990—SS–12 Core Drilled, p. 2.3.

Plymold Price List p. 42—Wall Style Single, Wheelchair Accessible Booth.

*Primary Examiner*—Milton Nelson, Jr.

*Attorney, Agent, or Firm*—Gottlieb Rackman & Reisman PC

[57] ABSTRACT

A freestandable booth (30), such as for dining, having a holder (34) for a table (36) and/or other appurtenances projecting from the seating (32), thus enabling the seating (32) to be made along any planform and yet maintaining vacancy beneath the appurtenances while forward of the seating (32). Two or more such seating units (32) may also be variously clustered so as to share a common holder (34) or a common element or elements.

26 Claims, 14 Drawing Sheets

UNITARY TABLE AND SURROUNDIVE SEATING

BACKGROUND—FIELD OF INVENTION

The present invention relates to furniture and more specifically to tables and booths where the seating is attached to the table.

BACKGROUND—DESCRIPTION OF PRIOR ART

Unitary furniture is common in restaurant type unitary booths and in picnic type unitary booths. The restaurant type booths are limited to parallel seating configurations, afford substantially unencumbered space beneath the table, and usually have minimal contact with the floor to facilitate floor cleaning. The picnic type unitary booths, often used in food service areas, patios, and the like, are configurably unlimited, encumber the space beneath the table with connecting bars, supporting bars, umbrella bases, and the like, often have maximal contact with the floor, largely preclude interseat slidable accessibility, and engender perimetral walkways for seating access. Demands for other than parallel restaurant type unitary booths and demands for unencumbered picnic type unitary booths with slidable seating accessibility currently need be satisfied with separate seating and separate table. Separate seating and separate table are frequently unsatisfactory in that, firstly, separate chairs, when used in a corner setting for instance, may require relocation of intervening chairs to access remote chairs; secondly, separate tables at best rest upon a pillar and pedestal and at worst rest upon multiple legs with potential occupants frequently rubbing various articles of clothing and/or bumping various body parts against these legs or pillar and pedestal while negotiating access to their seats and often while sitting as well; thirdly, a separate table and separate chairs for four people may have as many as twenty or more furniture legs in addition to eight occupant legs, which may cause a great deal of interference; lastly, floor cleaning beneath separate table and separate seating often warrants relocating the table and seating, cleaning the floor, and then restoring the table and seating to their original positions rather than inefficiently slaloming with a cleaning implement around the various furniture legs. The daily relocation and restoration of all the furniture is laborious, difficult, time consuming, and expensive. Thus, short of columnal embedment of table and seating, such embedment more readily classifiable as building construction than furniture, viable options for the host of aforementioned detriments are non-existent.

OBJECTS AND ADVANTAGES

Accordingly, several objects and advantages of the Unitary Table and Surroundive Seating are:

1—Limitless surroundive seating configuribility with unencumbered space beneath the table.

2—Rationally full slidable seating accessibility preclusive of perimetral walkways.

3—Unimpedimentary appurtenancibility.

4—Easy floor cleaning by limitation of floor contact.

FURTHER OBJECTS AND ADVANTAGES

5—Wheelchair accessibility and embracement.

6—Appurtenancibility with diverse elements making the unit universally utilizable for any suitable purpose such as dining, working, recreation, and etcetera, in restaurants, residences, education, industry, commerce, and etcetera.

7—Constructibility by any suitable method, section, material, and dimension.

8—Clusteribility with an element in common.

9—Knock down and flat knock down capability to enable ingress through narrow doorways and into small areas.

10—Stable freestandibility.

11—Unitary presence and unitary synergism which, because of increased mass, or because of novelty,or because of enhanced functionality, or because of numerous other reasons, cause the unit to be far more than the sum of the parts.

Other objects and advantages of the Unitary Table and Surroundive seating will become apparent from a consideration of the drawings and ensuing description. The drawings and descriptions are sequenced beginning with least number of elements required for the invention and proceeding therefrom. Therefore, the order of presentation should not necessarily imply an order of preference.

DRAWING FIGURES, ALL IN PERSPECTIVE

FIG. 1 Bulky circle planform.

FIG. 2 Bulky open circle planform.

FIG. 3 Bulky open circle planform with some more appurtenances.

FIG. 4 Clustered back to back pair of bulky open circle planforms.

FIG. 5 Skeletal open circle planform.

FIG. 6 Skeletal open circle planform, second construction.

FIG. 7 Skeletal open circle planform, third construction.

FIG. 8 Skeletal open pentagon planform.

FIG. 9 Skeletal open combinational planform.

FIG. 10 Skeletal angle planform.

FIG. 11 Exploded skeletal angle planform.

FIG. 12 Completed angle planform.

FIG. 13 Clustered face to face pair of bulky open circle planforms.

FIG. 14 Clustered linearly quadrivial skeletal planforms.

REFERENCE NUMERALS IN DRAWINGS

All numerals shown below will be prefixed by Fig. numeral when appearing in a drawing and when described.

30 embodiment
32 base
34 holder
36 table, appurtenant
38 stretcher
40 leg
42 seating and backrest, combinational
44 seating
46 backrest
48 boom, appurtenant
50 boomlet, appurtenant
52 bracket, seating relief
56 skid
58 apperture for holder
60 transfer bar
62 translateral

64 structural hole and/or fastener
68 wing, backrest support
70 endplate, holey
72 boom extension, aftward
74 auxilliary table, appurtenant
76 holder extension, upward
82 hanger, appurtenant
84 taper, witness
86 gusset
88 leg extension, upper

DETAILED DESCRIPTION OF THE PREFERRED EMBODIMENTS

Various embodiments of the present invention are shown in FIG. 1 through FIG. 14. As the choices of materials, sections, dimensions, and planforms, are unlimited, and as there may need be a fluidic compensatory interconnectivity amongst constituent elements where an alteration of an element may engender an alteration of a different element, specificities regarding materials, sections, dimensions, and planforms, are necessarily sparing. Further, many descriptions and illustrations, though perhaps described and illustrated at a particular embodiment, are intended to apply to any and all other embodiments which may gainfully employ such described and illustrated aspects, whether so stated or not. Thus, unless mutually exclusive, elements of any embodiment may readily be used at any other embodiment. It is recognized that one skilled in the art could readily change any or many things and make a functionally similar booth without departing from the spirit or scope of the invention.

Figure 1:
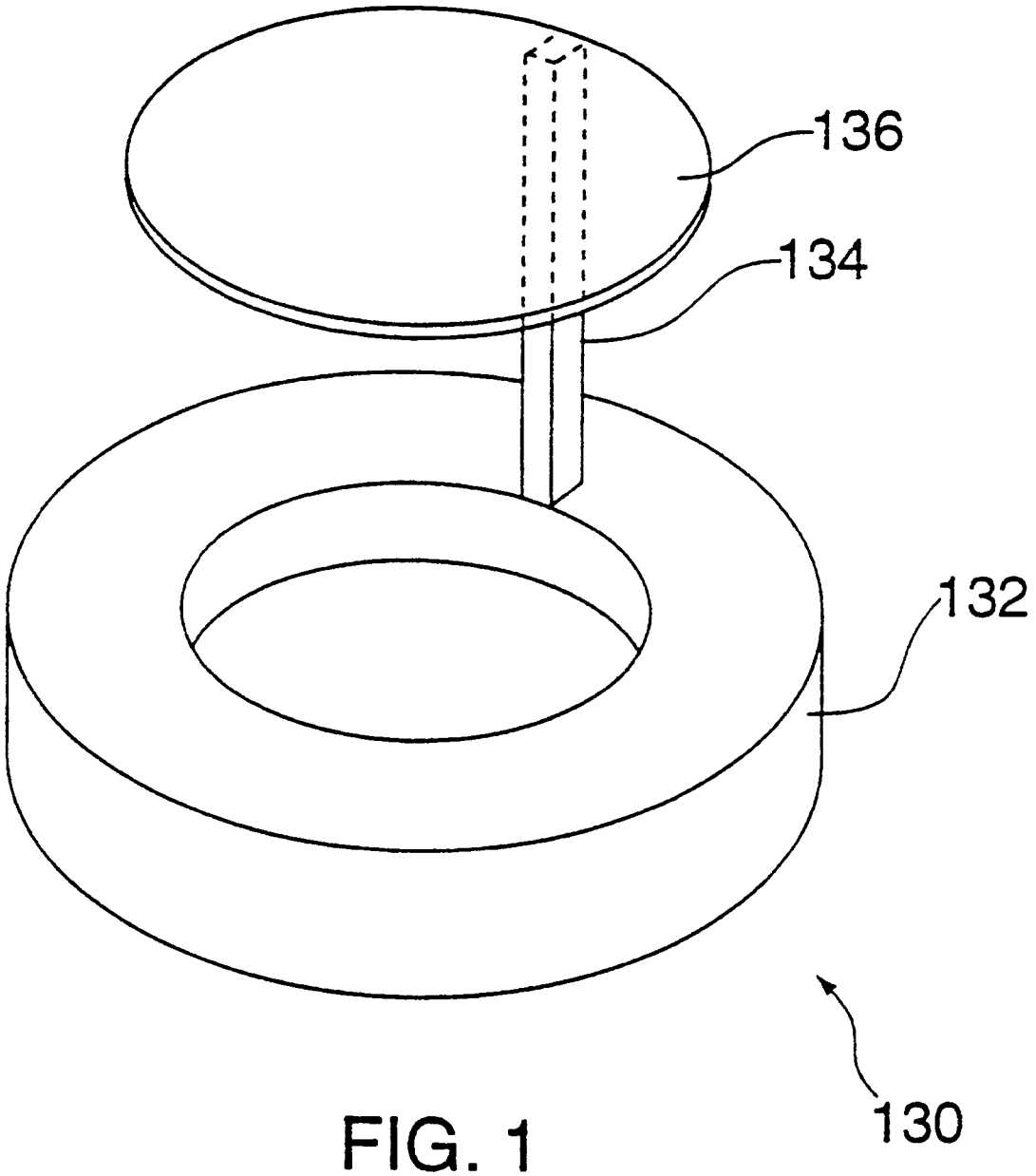

FIG. 1 shows the first embodiment 130 of the present invention. It includes: a base 132, a holder 134, and an appurtenance 136. These parts are discussed below.

Base 132, holder 134, and appurtenance 136, may each be made of any suitable material(s), section(s), dimension(s), and planform(s). Preferably, they are made of a rigid material such as steel. A steel construction would allow base 132 and holder 134, as well as holder 134 and appurtenance 136, to be rigidly secured to each other such as by a weld or by casting. The maximal cantileverable dimension of appurtenance 136 may be the maximal dimension of appurtenance 136. Appurtenance 136 may marginally overhang base 132 by a predetermined dimension. This dimension may be established at pleasure. Base 132, itself being the seating in the first embodiment, may be of a dimension similar to appurtenance 136 plus a dimension as may be comfortable for sitting. Base 132 may be at a height of approximately 18 inches above the floor at the top and may rest upon the floor at the bottom. If appurtenance 136 is to be a table, and if base 132 is at a height of 18 inches above the floor, then appurtenance 136 may be at a height of approximately 30 inches above the floor, or as may otherwise be convenient. Holder 134 may be placed at a predetermined location preferably within the margin of overhang between base 132 and appurtenance 136. Holder 134 may preferably be a slender section so as to not unduly detract from available seating space. The following dimensions, materials, sections, and planform, are respectively cited illustratively without prejudice to other dimensions, sections, materials, and planforms, which may be used toward a similar end: base 132: 20 inch by 18 inch steel tube rolled or cast or formed to an 80 inch outer diameter circle with the long side of the tube horizontal; holder 134: 3 inch by 3 inch steel bar square by approximately 11 inches long; appurtenance 136: 46 inch diameter steel plate disk. Assembly of the foregoing may preferably be by plumbly placing holder 134 3 inch by 3 inch bar within the aforesaid margin of overhang so as to at a first end contact and fix the underside of appurtenance 136 and at a second end contact and fix base 132 with both affixating contact areas being 3 inches by 3 inches. Holder 134 may alternatively at a predetermined intermediate longitudinal location fix appurtenance 136 and proceed further to fix additional appurtenances. Also, holder 134 may fix other appurtenances and exclude affixation of appurtenance 136. In either case of further procession, holder 134 may be lengthened as may be appropriate. Base 132 of this illustrative example may comfortably seat six people with each person having approximately 21 inner circumferential inches of seating width. Operationally, loads imposed upon appurtenances are transmitted through the holder 134 to base 132 and dispersed within the footprint of base 132.

Figure 2:
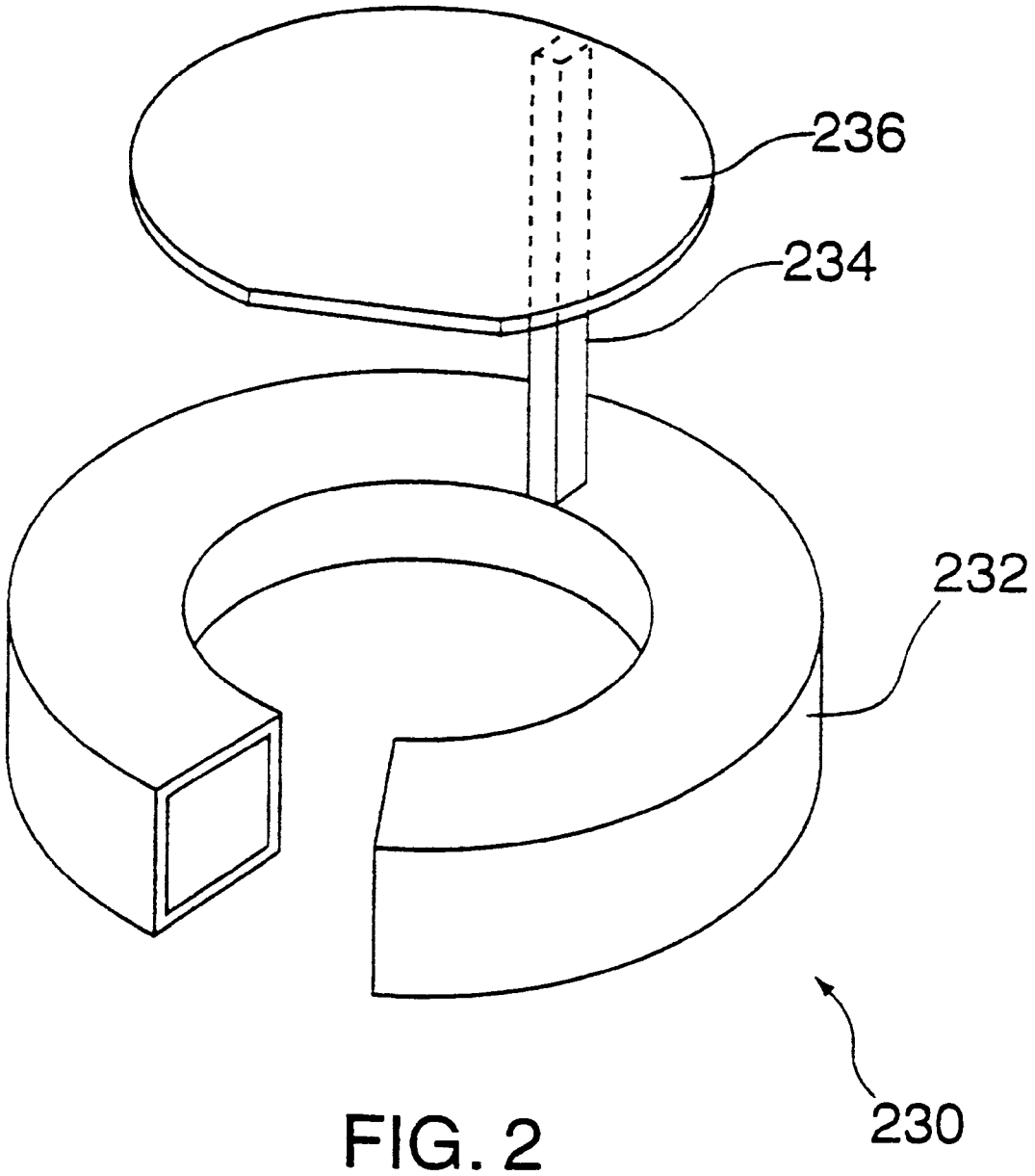

FIG. 2 shows the second embodiment 230 of the present invention. Parts of the second embodiment that are similar to parts of the first embodiment have the same numbers except for the leading digit, and will not be described a second time. The second embodiment 230 uses a base 232, which is an open planform, and an appurtenance 236. The open planform may be considered an abbreviation of a closed planform. Appurtenance 236 may delete part or all of the planform abbreviation, or it may encompass the abbreviation such as by the use of appurtenance 136 of the first embodiment. A holder 234 is preferably placed on the vertical plane of symmetry of base 232 preferably diametrically opposed to the center of the planform abbreviation. Operationally, this partially surroundive unit may belong to one of at least three unloaded classes, and they are: center of gravity fore, upon, or aft, of the edges of the planform opening of base 232. These edges of the planform opening may perform as fulcrums about which the unit may tilt. With due consideration given to service loading, tilt countermeasures, when required, may belong to one or more of at least four classes, and they are: ballast, anchorage, prop, and fulcrum transfer. Ballast may be uniformly, or locally, employed, conveniently through the use of suitably weighty material at locations as may be appropriate. When employed locally, the ballast may preferably be placed at a maximal lever arm distance relative to the fulcrum axis or axes. Anchorage to adjacent building construction may similarly be employed, preferably by affixing the embodiment at a maximal lever arm distance relative to the fulcrum axis or axes. Such affixation may be by a simple hole drilled upon a convenient location of the embodiment and employing fasteners suitable to the building construction through the hole. A local prop, or post, may be employed as may be required or as may be desired. An example of such a requirement may be extreme or heavy service loading of appurtenance 236. An example of such a desire may be an aversion, or inability, to ballast or anchor. Such a post may be a common post commonly fixed as may be most desirable and thus is not illustrated. Fulcrum transfer will be discussed at the description of FIG. 5. Any or all tilt countermeasures may be used to defeat fore, aft, or lateral, tilting.

Figure 3:
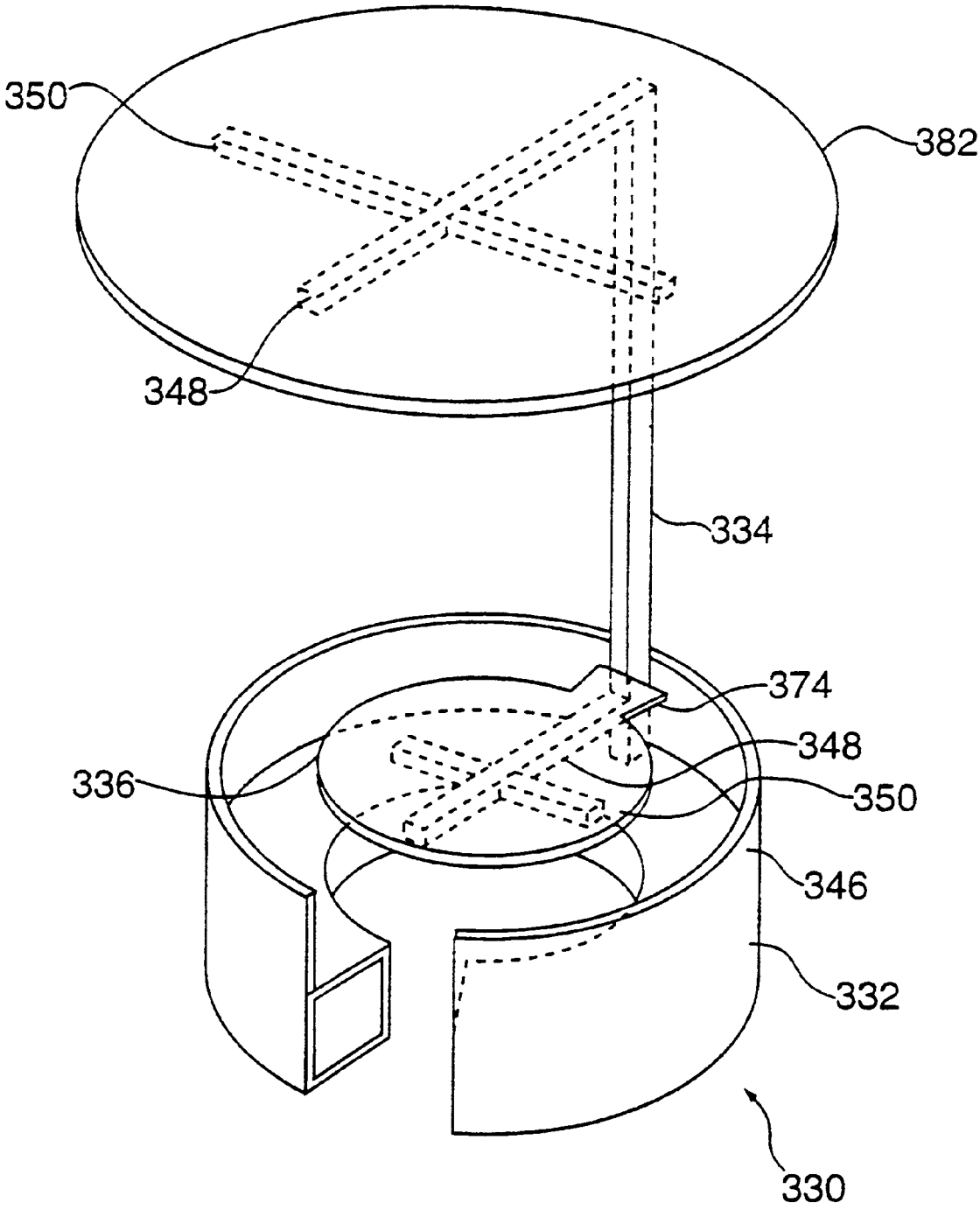

FIG. 3 shows the third embodiment 330 of the present invention. Parts similar to parts of the previous embodiments are similarly numbered, except for the leading digit, and will not be described again. The third embodiment 330 is different from the second embodiment in the length and location of a holder 334, and in the addition of several appurtenances, namely: a backrest 346, a boom 348, a boomlet 350, an auxilliary table 374, and a canopy 382. Holder 334 has been located flush aft with base 332 and has a length to attain a height as may be appropriate for canopy 382. Holder 334 may fix boom 348 at a convenient table height and may fix another boom 348 at a convenient canopy height. The booms may fix the boomlets as may be convenient or desirable. The booms and boomlets may be steel tube 3 inches by 3 inches by 3/16 inch thick and steel tube 2 inches by 2 inches by 1/8 inch thick, repectively, and may serve to diminish the requisite strength of the materials which they may support, such as a table 336 which may consequently be made of a lightweight material such as plastic laminated 3/4 inch plywood, and such as auxilliary table 374 which may be made similarly, and such as canopy 382 which may be made of cloth. The planform of a table 336 may be as at table 136 or at table 236, and the planform and dimension of canopy 382 may be as suitable or desirable. As the holder and the base may be flushback, backrest 346 may interfix the holder and thus provide additional matual rigidity. The holder may be plumb, or alternatively may slope, as may be desired.

Figure 4:
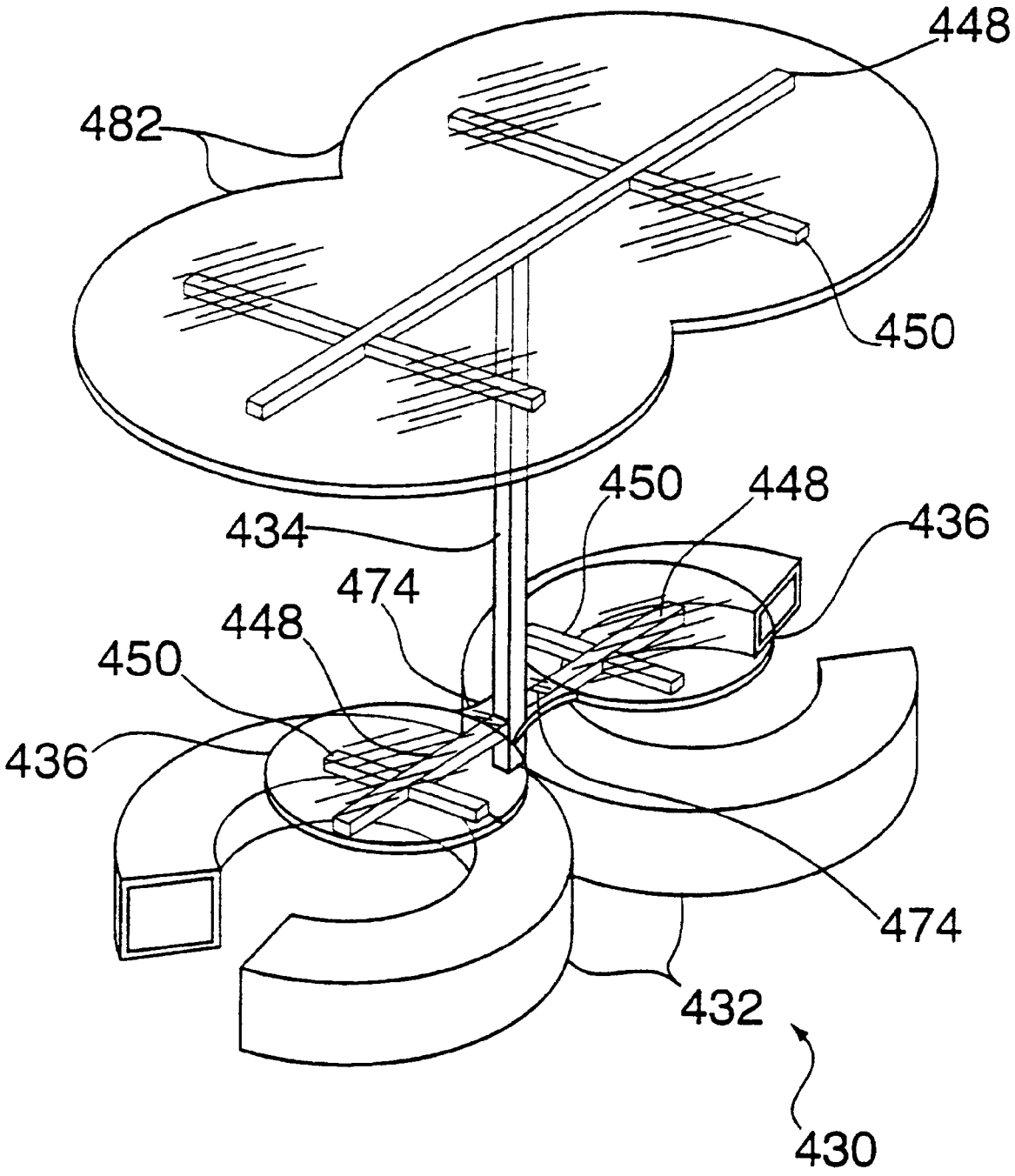

FIG. 4 shows the fourth embodiment 430 of the present invention. The fourth embodiment is different from the previous embodiments in the clustering. Two or more compatible planform embodiments may be arranged to in common affix an element, such as a holder 434. A pair of bases 432 may be placed back to back and holder 434 may straddle and fix the pair.

Figure 5:
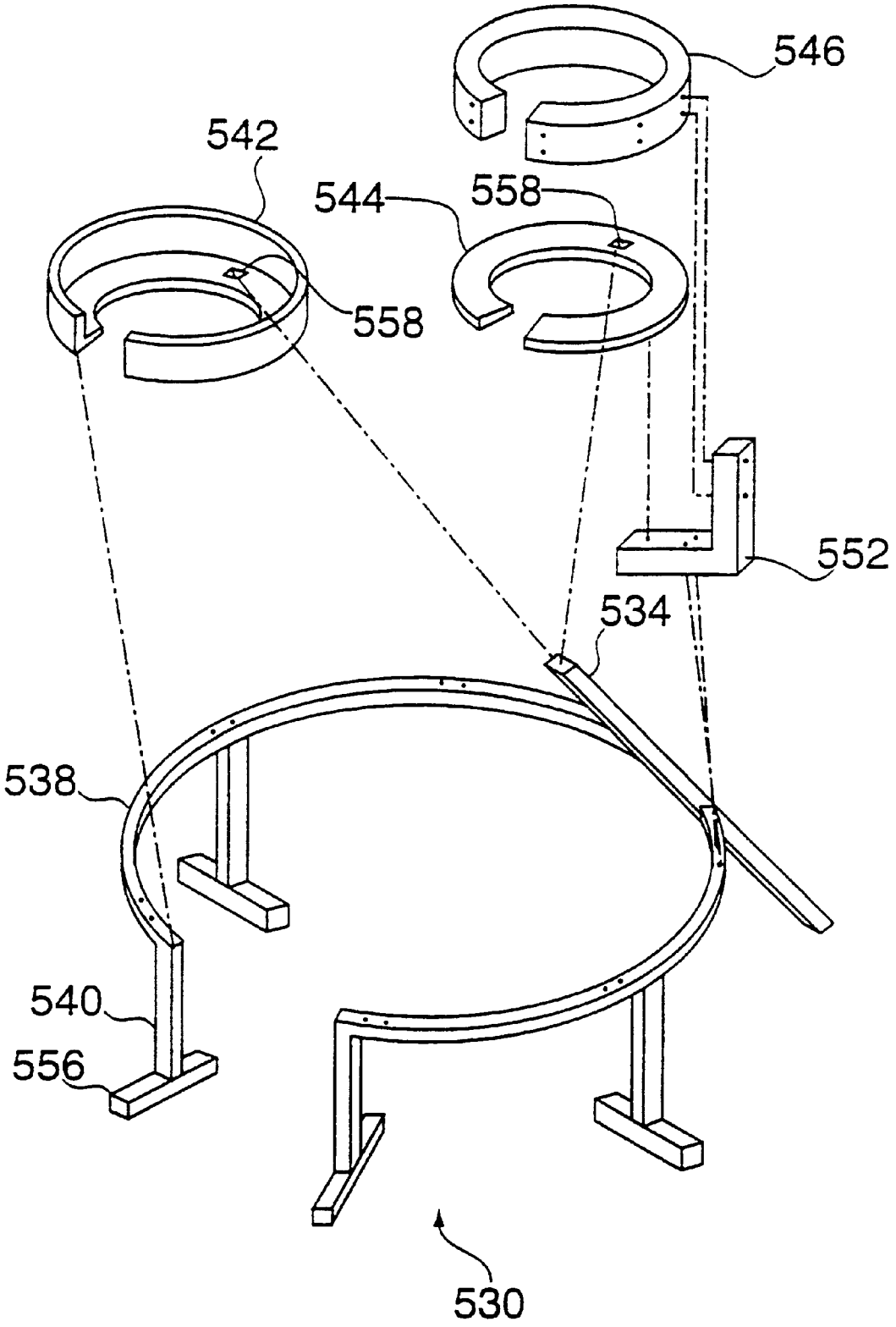

FIG. 5 shows the fifth embodiment 530 of the present invention. The fifth embodiment is different from the previous embodiments in the material section, and the construction, of a base 532, and in the provision for a separate seating 542. The separation of the seating function from the base function enables greater versatility in the choice of componentry and construction. Base 532 may include a horizontal support element, such as a stretcher 538, and a vertical support mechanism, such as a leg 540. Leg 540 may at a first end fix a first end of a stretcher 538 and may at a second end rest upon a floor. A pair of such legged stretcher 538 may at a second end interfix a holder 534. Holder 534, in this embodiment an inclined transverse, may also serve as an aft leg because it inclines from the previously mentioned margin of overhang at a first end to an aftmost leg position on the floor at a second end. Illustratively, base 532 and holder 534 may both be made of steel tube 3 inches by 3 inches by 3/16 inch thick, and seating 542 may be made of 1 1/8 inch thick contourformed plastic laminated plywood. Affixation of seating 542 to base 532 may be by means prevalent in the art. An aperture 558 in seating 542 may readily accomodate throughput of holder 534. Operationally, the fifth embodiment may benefit from a transfer of a fulcrum axis or axes. This may preferably be achieved discretely so as to enhance aesthetic appeal while endeavoring to refrain from introducing occupant obstructive and/or object defeating elements. One such fulcrum axis has been transferred through the sloping, or inclining, of holder 534 so as to attain a maximal aftmost position upon the floor so as to resist aftward tilting. Additionally, both forefulcrum axes have been shifted relative to their positions in previous embodiments by their incorporation into a single, substantially centered element such as leg 540. Such slenderness, as the leg may possess, though perhaps epitomous of non-obstructionism and aesthetic appeal, may in some applications be counterproductive to floor loadbearing distribution and to tilt restraint. Where this is so, countermeasures such as a transversal skid 556 may be employed such as by affixation to leg 540. The ends of the skid may reclaim the more favorable fulcrum axes and the skid itself may distribute the point load which would have existed at the floor bearing end of the leg had it not been attached to the skid. Another example of a point load relief mechanism may be a seating relief bracket 552 which may be used to minimize the required strength of a seating 542, or may be used to enable utilization of a separate seating 544 and a separate backrest 546.

Figure 6:
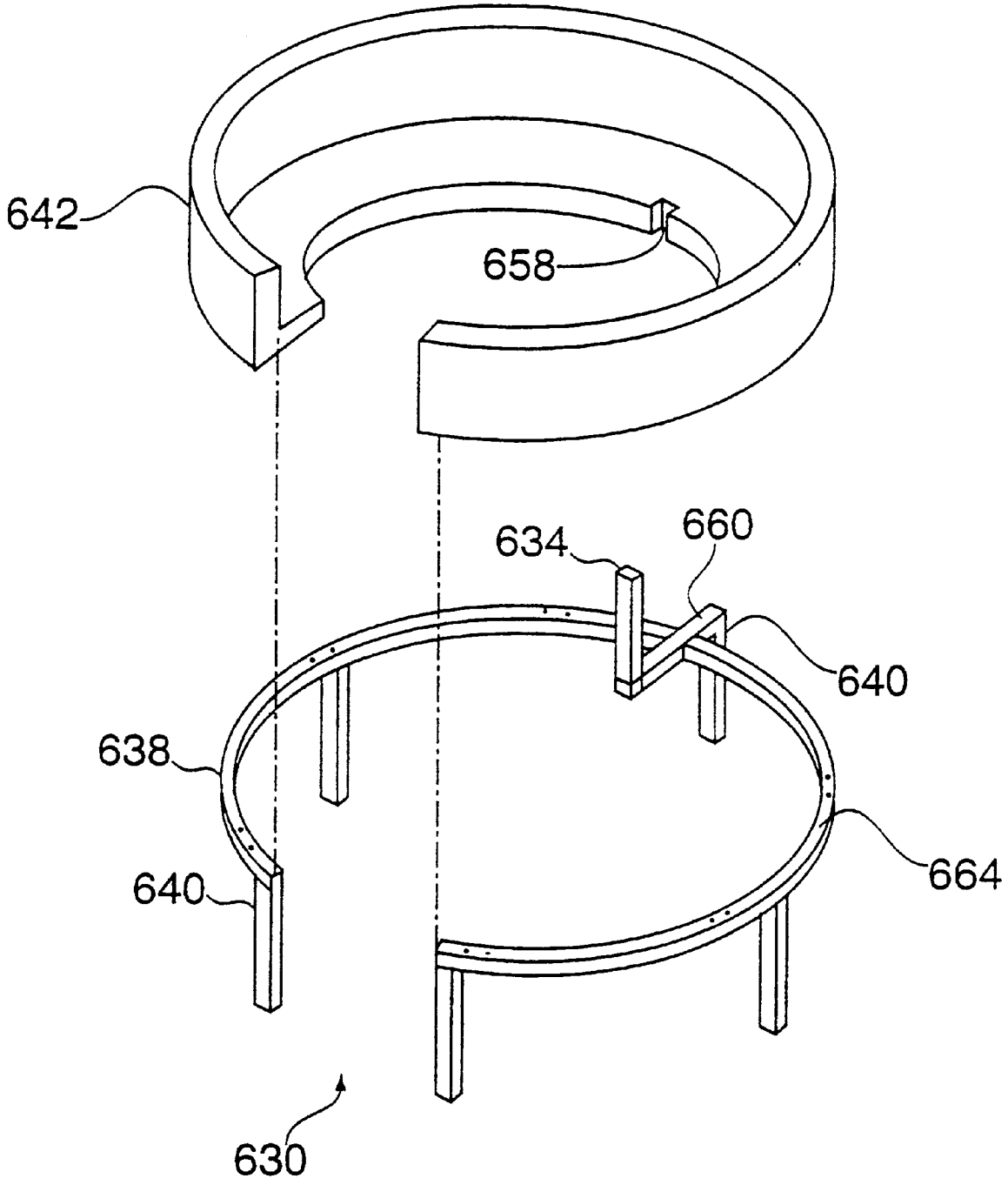

FIG. 6 shows the sixth embodiment 630 of the present invention. The sixth embodiment is different from the fifth embodiment in a holder 634 which additionally comprises a leg 640 and a transfer bar 660. These three elements may form a zee shape which favorably places holder 634 flush front with a seating 642 and favorably places leg 640 aftmostly. Transfer bar 660 may occupy the stem position of the zee shape and may readily be interfixed by a pair of a stretcher 638.

An aperture 658 in seating 642 may enable throughput of holder 634.

Figure 7:
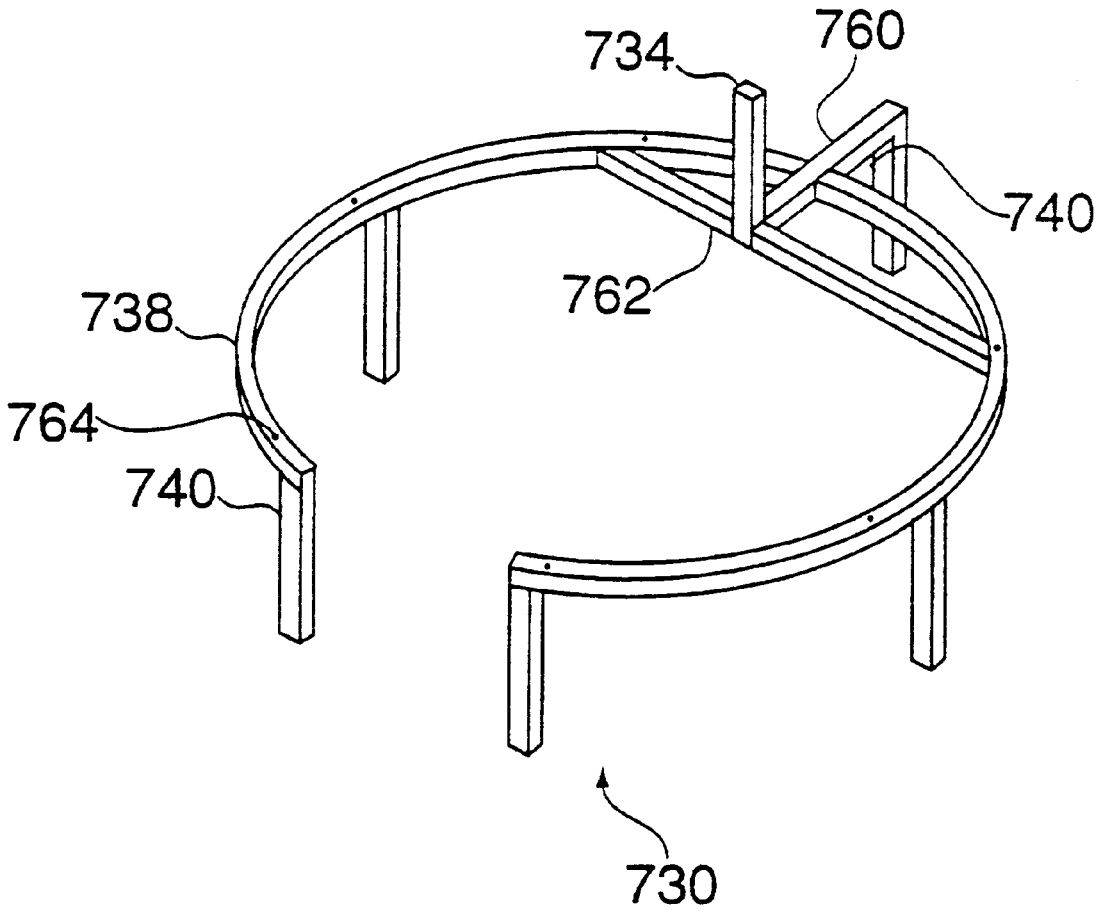

FIG. 7 shows the seventh embodiment 730 of the present invention. The seventh embodiment is different from the sixth embodiment in the addition of a translateral bar 762. Translateral bar 762 at a first end may fix a holder 734, and at a second end may fix a stretcher 738. Though the translateral bar is preferably coplanar to the stretcher and may thus be visually obscured by a seating 742, it may alternatively be aplanar to the stretcher and/or along any compass to affix any other element which may prove useful in unital rigidification. The translateral bar may be useful in the reduction of section and strength requirements.

Figure 8:
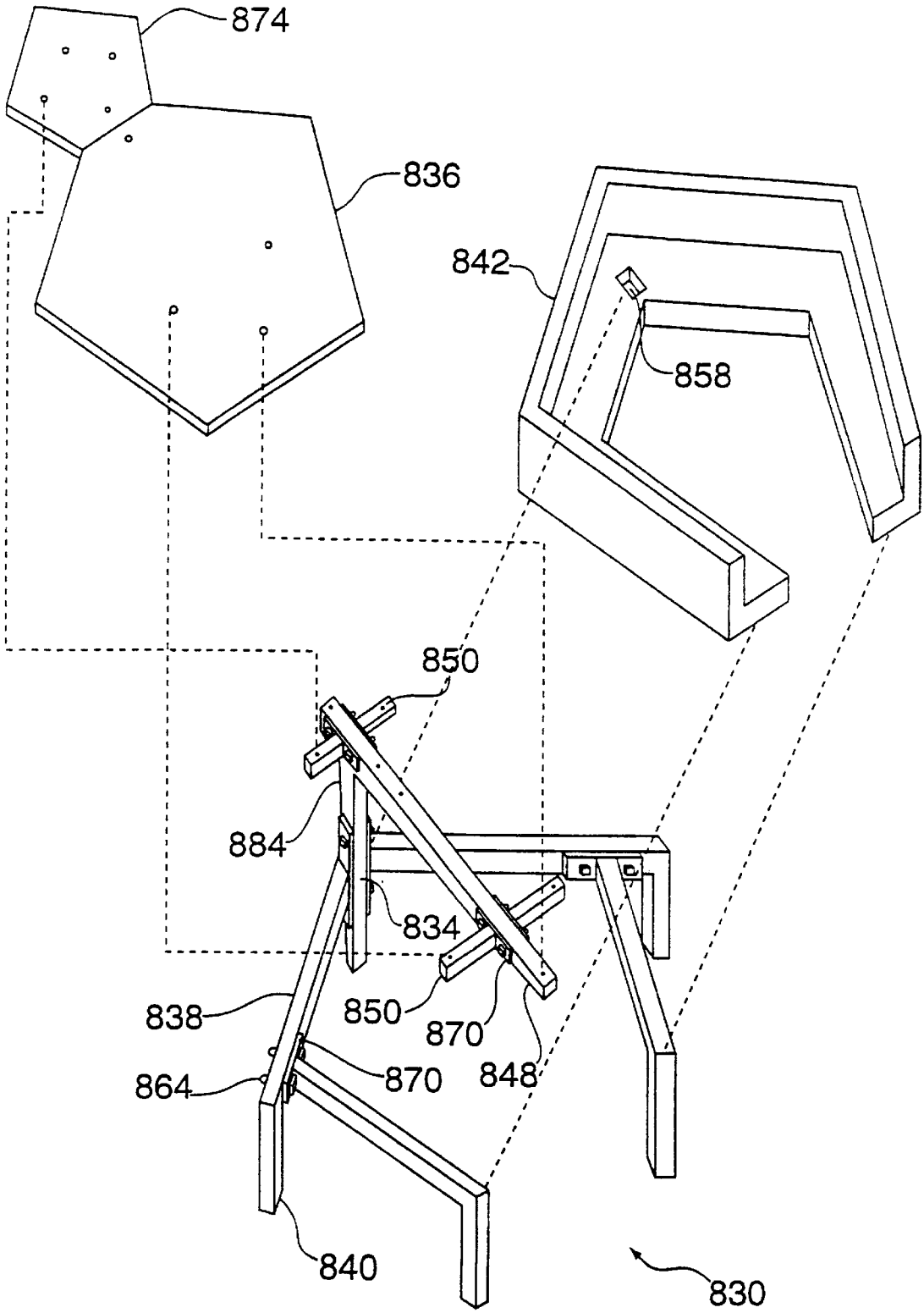
Figure 9:
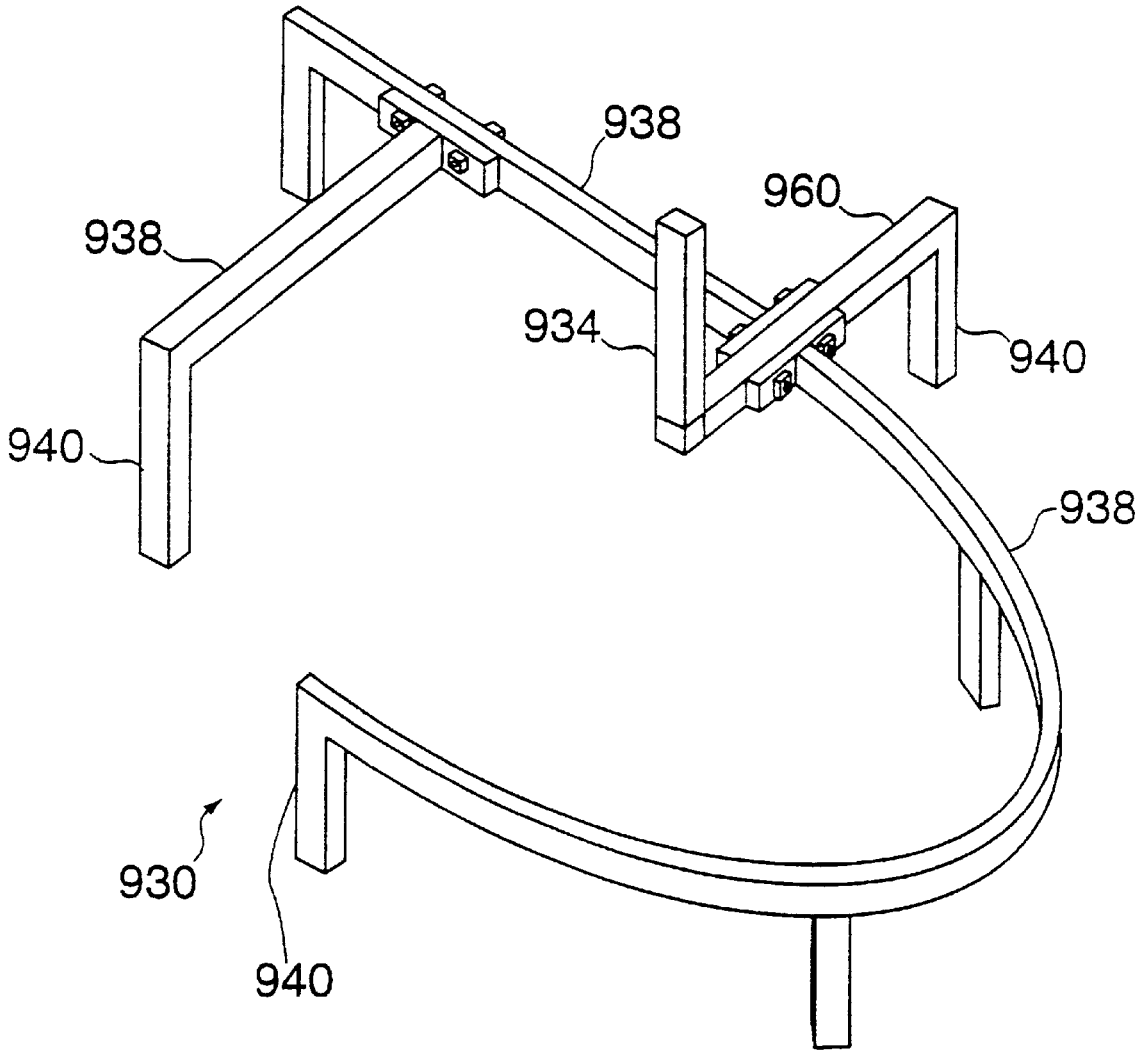
Figure 10:
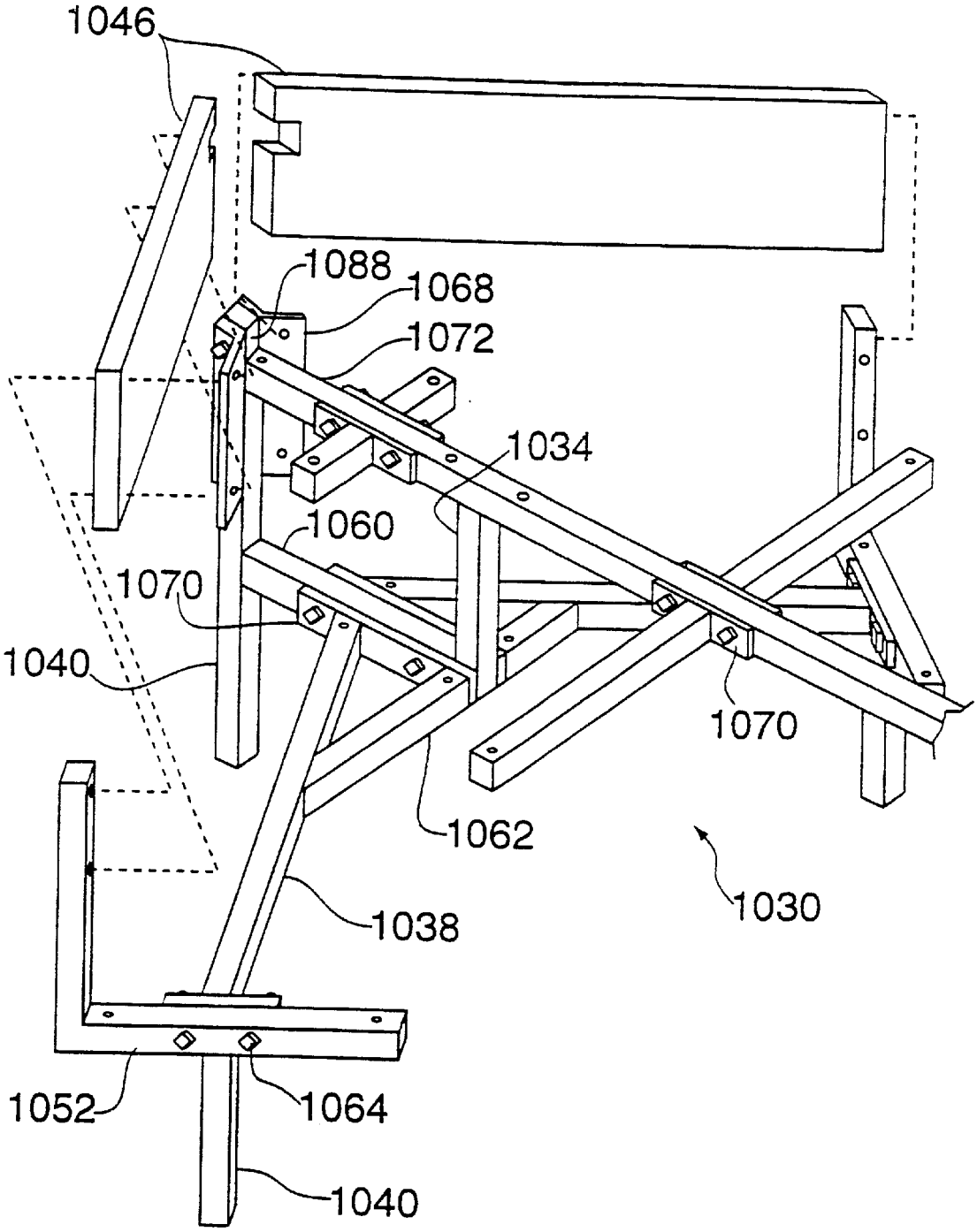

FIG. 8, FIG. 9, and FIG. 10, respectively reconfigure the planforms of FIG. 5, FIG. 6, and FIG. 7, each in knock down form. Arbitrarily selected from a large field of knock down methods is holey endplating which may also be described as holey flanging. Thus, a protruding element may be provided with and fixed to a suitable holey endplate 70 and a recipient element may be provided with a set of structural holes 64 to communicate with a set of structural holes 64 of the holey endplate. Hereinafter, reference to a holey endplate is indicative of provision of communicating structural holes in the recipient element, and of provision of a set of structural fasteners 64 such as nuts and bolts to secure the holey endplate to the recipient element.

Figure 14:
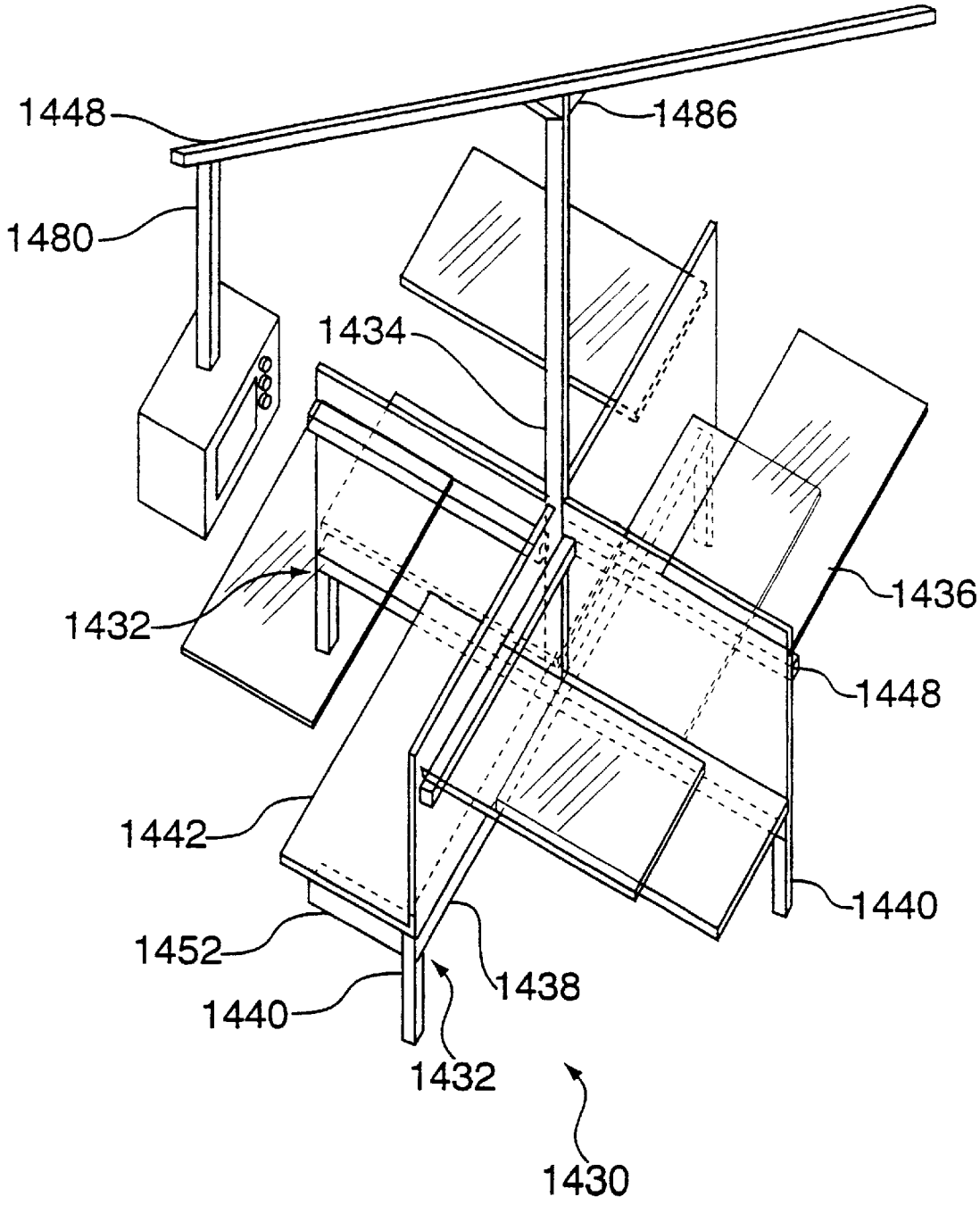

FIG. 8 shows the eighth embodiment 830 of the present invention. An open pentagon planform which deletes the fifth side for seating accessibility, the eighth embodiment additionally differs from the fifth embodiment in the following ways: at an interfixity of a recipient holder 834, a protruding stretcher 838 is endplated; at a recipient extant end of a holder 834 connected stretcher 838, a protruding ongoing stretcher 838 is endplated; at an interfixity of a recipient boom 848, a protruding boomlet 850 is endplated; the junction of the holder and the boom may be tapered as witnessed by 884. Such tapering may be for material savings, aesthetic appeal, occupant room augmentation, and added rigidity. A valid alternative may be a gusset 1486 as illustrated at FIG. 14.

FIG. 9 shows the ninth embodiment 930 of the present invention. A combinational curvate and angular planform, the ninth embodiment additionally differs from the sixth embodiment in endplating a protruding stretcher 938 at a recipient transfer bar 960, and in endplating of a protruding ongoing stretcher 938 at a recipient transfer bar 960 connected stretcher 938.

FIG. 10 shows the tenth embodiment 1030 of the present invention. An angle planform, the tenth embodiment additionally differs from the seventh embodiment and is novel beyond the eighth and ninth embodiments as follows: at an interfixity of a recipient transfer bar 1060, a protruding stretcher 1038 and a protruding translateral 1062 are commonly endplated; at a recipient seating relief bracket 1052, a protruding stretcher 1038 is endplated; seating relief bracket 1052 may be weldably fixed to a leg 1040; an upper extension of leg 1088 may weldably fix an aftward extension of boom 1072; a protruding wing 1068 may be endplated at a recipient upper extension of leg 1088. Wings 1068 may, jointly with the seating relief bracket, support a backrest 1046.

Figure 11:
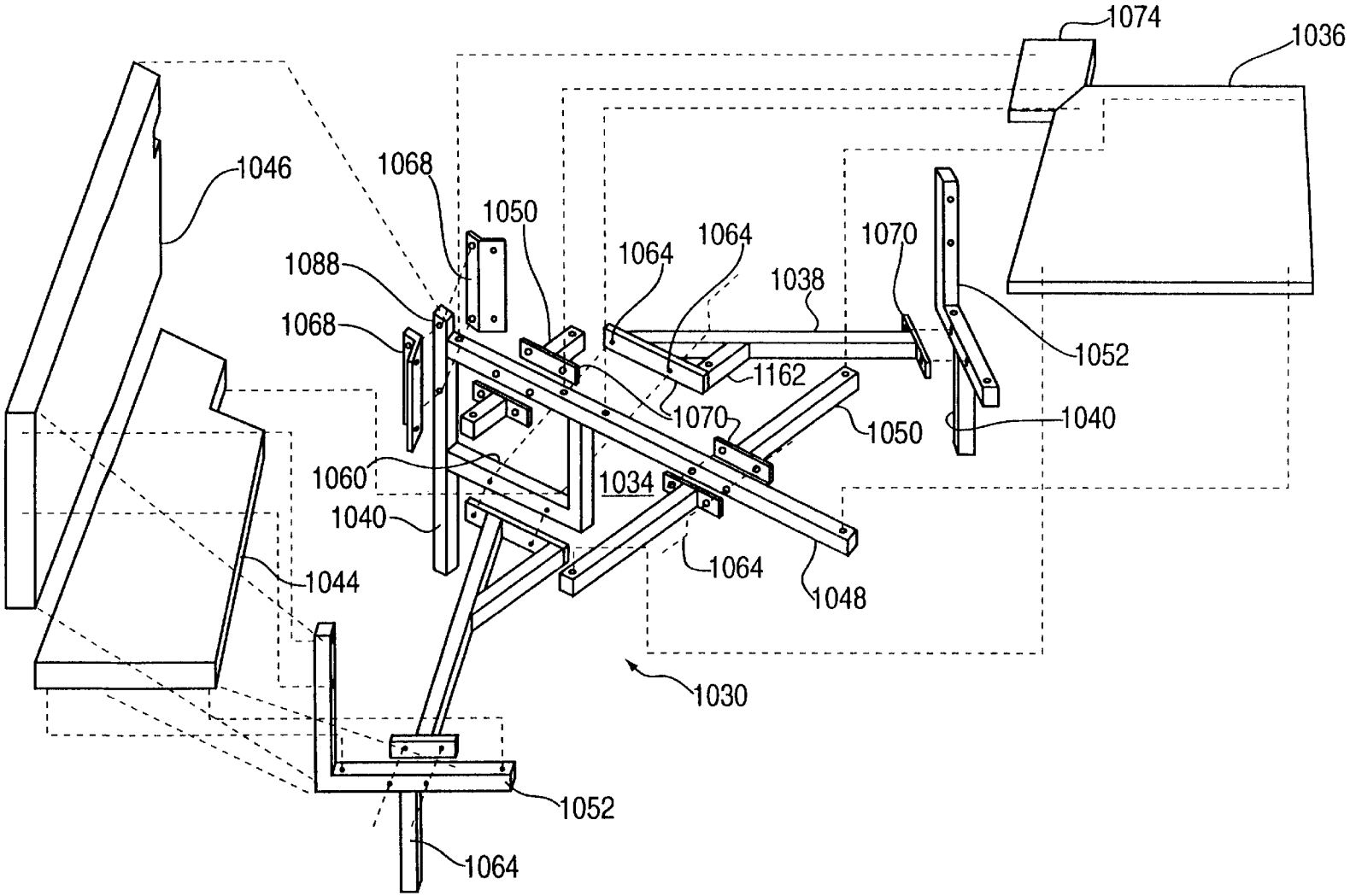

FIG. 11 explodes the tenth embodiment for clarity.

Figure 12:
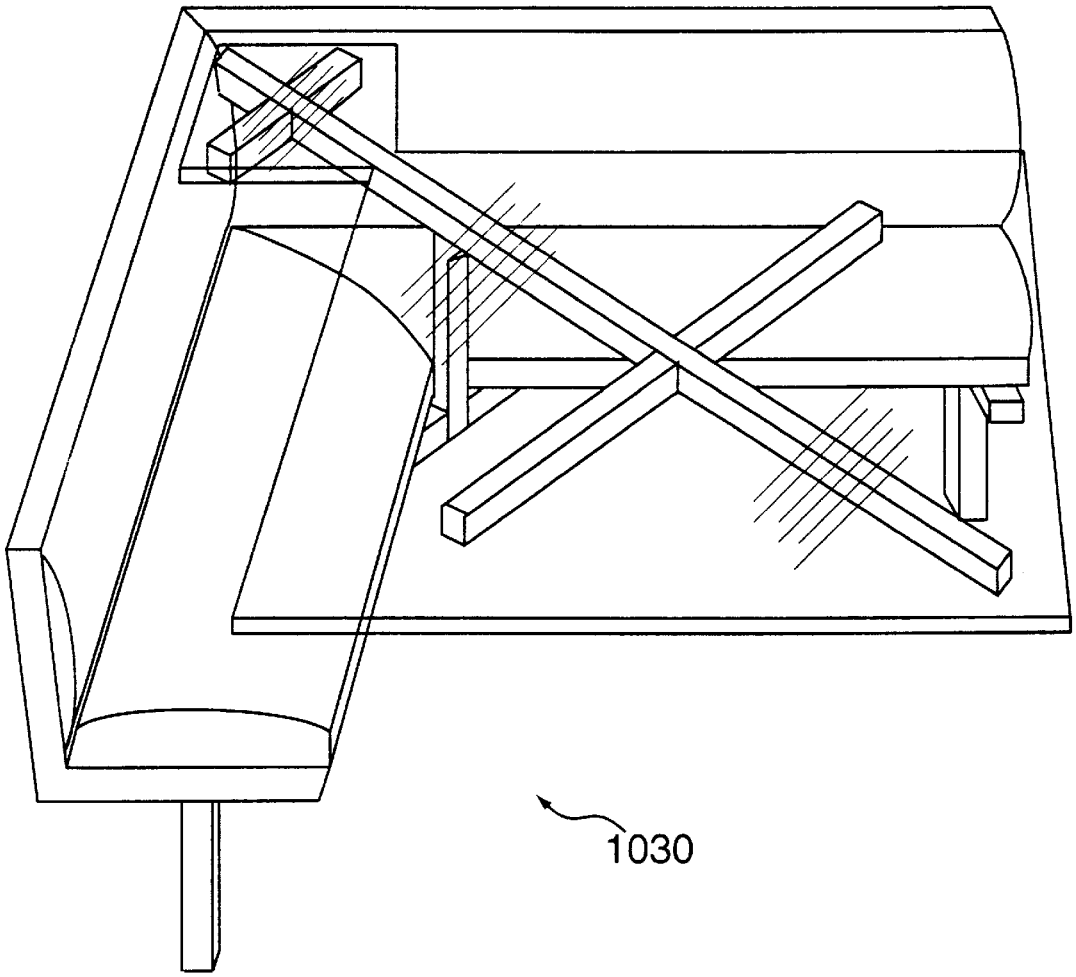

FIG. 12 shows a completed assembly of the tenth embodiment.

Figure 13:
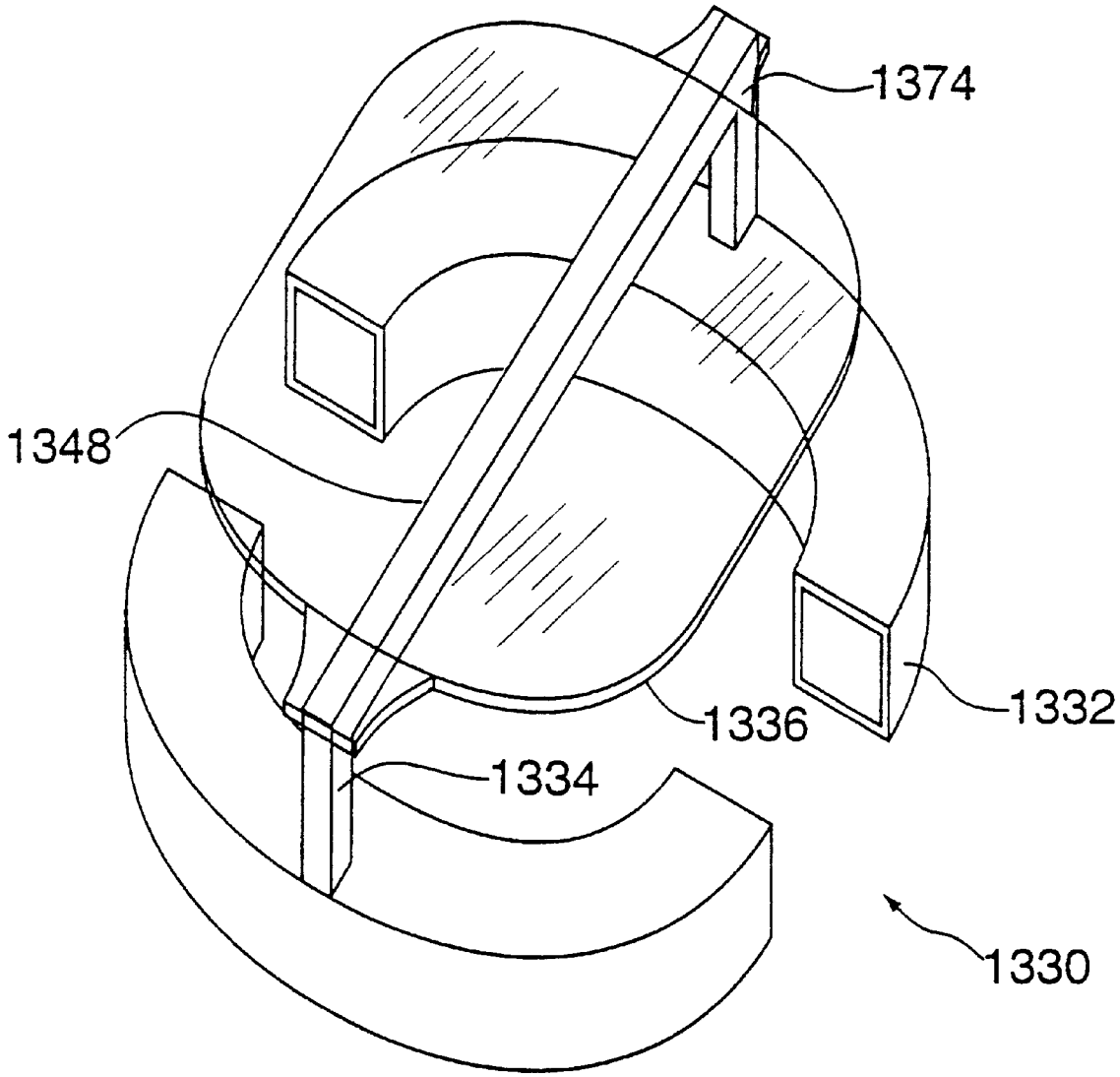

FIG. 13 shows the embodiment of the present invention. In this embodiment, at least two booths may face a substantially common focus to cluster and hold an element, in this case a boom 1348, in common. Though shown spaced apart for ease of seating accessibility, a pair or more of base 1332 may instead be continuous. A backrest (not shown) may readily be affixed to the base, intermittently so if so required for seating accessibility.

FIG. 14 shows the embodiment 1430 of the present invention. In this embodiment, three or more linear planform bases 1432 may cluster by angular divergeance from a holder 1434 they affix in common. Additionally shown are a gusset 1486 which may be used to strengthen connections without needing to increase section size or strength, and a hanger 1480 which may be fixed to and suspended from a boom 1448 such as for affixation of a computer monitor. A seat-relief bracket 1452 or a modified form thereof may be used to assist in support of a seating 1442.

SUMMARY, RAMIFICATIONS, AND SCOPE

Accordingly, the reader will see that the booth of this invention can be used to establish total vacancy forward of the seating and beneath the appurtenances while minimally bearing on the floor at the base. Effectuated are limitless planforms, slidable seating accessibility, unimpedimentary appurtenancibility, easy floor cleaning, wheelchair accessibility and embracement, diverse appurtenancibility, universal utilizability, universal constructibility, clusterability, knock downibility, flat knockdownibility, stable freestandability, unitary presence, and walkway absence.

Although the foregoing descriptions contain many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

I claim:

1. A unitary table-and-seat assembly comprising:

a post extending upwardly;

a base, being attached to said post and defining a substantially empty seating area, said base including a first seating section and a second seating section, said first and second seating sections being adjacent to each other and extending non-parallel with respect to each other to define a common intermediate zone therebetween; and an appurtenance mounted on said post in a cantilevered manner and extending over said seating area to form a table;

said appurtenance having a perimeter and said first and second seating sections extending at least partially along said perimeter beneath said table without protruding into said empty seating area.

2. The assembly of claim 1 wherein said base surrounds said empty seating area.

3. The assembly of claim 1 wherein said base is at least partially curvilinear.

4. The assembly of claim 1 wherein said seat is at least partially curvilinear.

5. The assembly of claim 1 wherein said base is at least partially polygonal.

6. The assembly of claim 1 wherein each of said seating sections has a lateral end, said lateral ends being joined to said common intermediate zone.

7. The assembly of claim 1 wherein said seating sections extend in different directions from said common intermediate zone.

8. The assembly of claim 1 further comprising coupling elements that directly attach said seating sections to said post.

9. The assembly of claim 1 wherein said first and second seating sections each include a vertical leg, a transversal structural member attached to said leg, a longitudinal structural member extending from said transversal structural member to said past and a flat seating member extending over and attached to said structural members.

10. The assembly of claim 9 wherein said first and second seat sections further comprises an upright attached to said transversal structural member and a seatback attached to said upright and extending to said post.

11. The assembly of claim 1 wherein said post comprises a support with an upright member having a top and an upper horizontal member extending over said seating area and attached to said top, with said appurtenance being attached to said upper horizontal member.

12. The assembly of claim 11 wherein said post further comprises lateral horizontal beams attached to said upper horizontal member, said lateral horizontal beams and said horizontal member cooperating to support said appurtenance.

13. The assembly of claim 11 wherein said post further includes a lower horizontal member substantially parallel to said upper horizontal member, with said first and second seating sections being attached to said lower horizontal member.

14. A knock-down table-and-seat assembly comprising:

central member having a vertical element and a substantially horizontal element attached to said vertical element and extending in a cantilevered manner from said vertical element a first and a second lateral member disposed substantially perpendicular to each other, each having a free end;

coupling means for coupling said free ends to said central member;

first and second seat members, each being arranged and constructed for mounting on at least one of said lateral members to form a corresponding first and second seat, said seats defining an empty area; and a table member mounted on said horizontal element and extending over said empty area.

15. The assembly of claim 14 wherein said vertical element includes an upright extending from a ground level.

16. The assembly of claim 15 wherein said upright further includes a horizontal member attached to said upright, lateral elements and couplers coupling said lateral elements to said horizontal member.

17. The assembly of claim 14 wherein said lateral members are linear.

18. The assembly of claim 14 wherein said central member and said lateral members define a rectangle.

19. The assembly of claim 14 wherein said central member and said first and second lateral seat members are made of a metallic material.

20. A unitary table-and-seat assembly comprising:

a base forming a seat and defining a substantially empty seating area, said base including a first seating section and a second seating section, said first and second seating sections being adjacent to and substantially perpendicular to each other to define a common intermediate zone there between;

a support attached to said base, said support being disposed in said intermediate zone and extending upwardly from said base over said empty seating area in a cantilevered manner; and an appurtenance mounted on said support, said appurtenance extending over said seating area to form a table.

21. An assembly comprising:

an upright post extending upwardly;

a table having a perimeter and being attached to said post in a cantilevered manner; and first and second seats, each seat having a first end attached to said upright post and extending away from said post along said perimeter, said seats being non-parallel to each other.

22. The assembly of claim 21 wherein each of said seats has a second end extending downwardly to support said seats.

23. The assembly of claim 21 wherein said first and second seats cooperate to define an empty area extending under said table.

24. The assembly of claim 21 further comprising a horizontal support having a first support end fixed to said post, with said table being attached to said support.

25. The assembly of claim 21 wherein said seats further comprise backs extending in parallel with said perimeter.

26. The assembly of claim 21 wherein said seats substantially surround said perimeter.

* * * * *